United States Patent [19]

de Reynal de Saint Michel

[11] Patent Number: 4,588,047

[45] Date of Patent: May 13, 1986

[54] QUICK-MEAL RESTAURANT INSTALLATION

[76] Inventor: Olivier de Reynal de Saint Michel, 14 rue des Anciens Beliers, 78730 Rochefort en Yvelines, France

[21] Appl. No.: 613,398

[22] Filed: May 22, 1984

[30] Foreign Application Priority Data

May 27, 1983 [FR] France ..... 83 08784

[51] Int. Cl.[4] ..... E04H 3/04

[52] U.S. Cl. ..... 186/38; 219/218

[58] Field of Search ..... 186/36, 38, 42–51; 219/214, 218; 312/236; 52/29, 31, 33

[56] References Cited

U.S. PATENT DOCUMENTS

| | | | |
|---|---|---|---|
| 751,681 | 2/1904 | Philippi | 186/46 |
| 1,705,112 | 3/1929 | Hall | 186/49 |
| 2,850,613 | 9/1958 | McCormick . | |
| 3,610,885 | 10/1971 | Zingg | 219/461 |
| 3,617,693 | 11/1971 | Shimosawa | 219/218 |
| 3,694,046 | 9/1972 | Gehrmann | 312/196 |
| 3,740,513 | 6/1973 | Peters, Jr. et al. | 219/218 X |
| 3,997,028 | 12/1976 | Lopez | 312/306 X |
| 4,034,200 | 7/1977 | Visagie | 219/218 |
| 4,040,693 | 8/1977 | Peterson et al. | 312/235 |

FOREIGN PATENT DOCUMENTS

| | | |
|---|---|---|
| 2508521 | 9/1976 | Fed. Rep. of Germany . |
| 82529 | 6/1980 | Luxembourg . |
| 7117850 | 6/1973 | Netherlands . |
| 895714 | 5/1962 | United Kingdom . |

*Primary Examiner*—F. J. Bartuska

*Attorney, Agent, or Firm*—Young & Thompson

[57] ABSTRACT

In a quick-meal restaurant installation, a service space is located on one side of a furniture unit and seats are provided for customers on the other side. The unit consists of modules assembled together and each having a portion forming a table. Each module is provided with cooking equipment such as an electric hotplate and an electric fryer, as well as an automatic dispenser fitted with push-buttons for selecting beverages. Suction hoods mounted on a beverage-dispenser support console serve to carry away cooking smoke through the interior of the console to a general collector duct and chimney.

5 Claims, 5 Drawing Figures

QUICK-MEAL RESTAURANT INSTALLATION

This invention relates to quick-meal restaurant installations of a type currently referred-to as "fast food" restaurants. More specifically, the invention is concerned with an installation of this type which is equipped with cooking means as well as means for dispensing beverages placed at the disposal of customers.

In the majority of cases, "fast food" restaurant installations for customer access comprise at least one room which is open to customers and in which seats such as chairs or stools are put at their disposal. At least one furniture unit, usually of substantial length, forms a separation between that part of the room which is reserved for customers and a service space. In this service space, waiters can bring to customers cooked food or generally speaking any food prepared in at least one other room equipped as a kitchen, as well as beverages drawn from dispensers which are accessible within the service space.

These installations therefore occupy a relatively large ground area and entail the need for a relatively large service staff, not only for preparing and cooking food but also for carrying food from the kitchen to the dining room and finally for serving beverages. For these reasons, the operation of such installations is relatively costly.

The present invention proposes to overcome this disadvantage while at the same time giving customers the posssibility of selecting the food which they desire to consume and of preparing such food according to taste.

To this end, the quick-meal restaurant installation in accordance with the invention comprises in a room open to customers a furniture unit so arranged as to define a service space on one side and seats for the use of customers on the other side. The installation is distinguished by the fact that the furniture unit is made up of modules assembled together, each module being constituted by a portion forming a table and being provided with cooking means as well as a beverage dispenser, at least one seat being placed opposite to each module.

Each customer can thus take a seat opposite to a module, can receive from a waiter who moves within the service space the food products in a fresh or frozen state which the customer desires to consume, can then cook the food himself or herself and can at the same time receive a beverage by means of the dispensers of the corresponding module.

In a preferred embodiment, the cooking means comprise at least one electric hotplate which is capable of operating as a meat grill and/or at least one electric deep fryer, the hotplate and/or the deep fryer being placed on the table of the module. Thus customers can prepare French fried potatoes and portions of grilled meat, which are the foods most commonly consumed in this type of establishment. However, the cooking means can also comprise at least one microwave oven, with the result that customers can cook in a very short time dishes which have previously been conditioned and prepared for this mode of cooking. By way of example, such dishes can consist of individual portions of frozen or deep-frozen dishes.

In order to reduce the space occupied by the cooking means on the table and also for safety reasons, the cooking means are advantageously incorporated in the surface of the table. This avoids any danger of upsetting of hotplates and oil contained in the trays of deep fryers by integrating these hotplates and trays in the plane of the table.

As an advantageous feature, the beverage dispenser is an automatic dispenser supported by a console and suspended above the table. This makes it easier to use, permits easy filling of a glass or tumbler which the customer does not need to lift from the table or which need not be lifted more than a very slight extent. It is therefore unnecessary for the customer to move or for the waiter to bring a glass filled with a beverage.

Preferably, the beverage dispenser is provided with push-buttons which can be depressed in order to select hot and/or cold drinks. The dispenser is also equipped with different means for inserting coins in order to initiate its operation. The customer can thus independently pay the price marked and help himself (or herself) to the drinks he (or she) has chosen.

The furniture unit of the installation in accordance with the invention can be constituted by the juxtaposed assembly of a predetermined number of modules each designed and arranged to satisfy the requirements of one customer at a time. It is also possible, however, that certain modules may be intended for two customers at the same time. Modules of this type are also equipped with separate cooking means for each of the two customers and two seats are of course associated with each module. However, only one beverage dispenser may be provided in this case.

In order to provide easier conditions of service, particularly at the time of setting knives, forks and spoons, of laying plates and glasses, of cleaning of a module after customers have left, and also in order to guarantee distribution of food products which have been kept in cold storage, a roller-track extends alongside the furniture unit on the same side as the service space. At least one container such as a freezer compartment, a garbage container and/or a container for plates and dishes or for knives, forks and spoons is (are) mounted so as to travel along the track.

In installations in accordance with the invention, the furniture unit consisting of juxtaposed modules can have in plan either an L-shape, a T-shape, or any other desired shape in order to utilize the available ground area to the maximum extent and to install the largest number of modules which is compatible with the service space defined on one side of the furniture unit.

However, the furniture unit advantageously has a U-shape in a horizontal plane and the service space is defined within said U-shaped unit. Without any need to move beyond the service space, a single employee is therefore able to serve a large number of customers who are seated at the different modules of the furniture unit.

Other features of the invention will be more apparent upon consideration of the following description and accompanying drawings, wherein.

Figure 1:
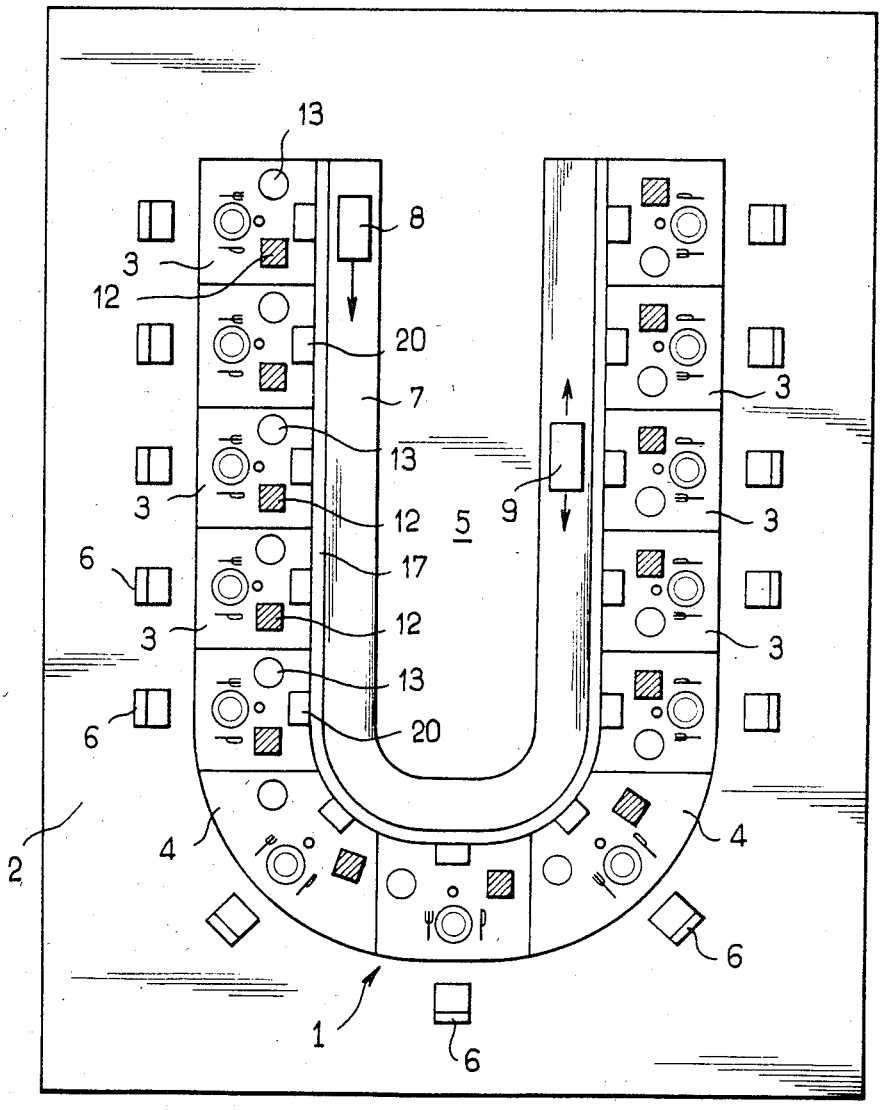
FIG. 1 is a plan view of a quick-meal restaurant installation.

Referring to FIG. 1, the quick-meal restaurant installation comprises a furniture unit 1 installed in a room 2 which is open to customers. The furniture unit 1 has a U-shape and is made up of thirteen modules arranged side by side, eleven of which are substantially rectangular modules 3 and two of which are curved corner modules 4. The U-shaped module 1 delimits between its two legs a service space 5 in which a person can move about for the purpose of serving customers. The different customers can sit on the seats 6 (chairs or stools) which are each placed opposite to a module 3 or 4.

A roller-track 7 extends alongside the furniture unit 1 on the inside of the U. A carriage 8 which travels on said track carries a freezer containing the different food products such as slices of meat or portions of precut and frozen French fried potatoes which the waiter can serve to customers. Another carriage 9 which carries a garbage container also travels on the roller track 7.

Figure 2:
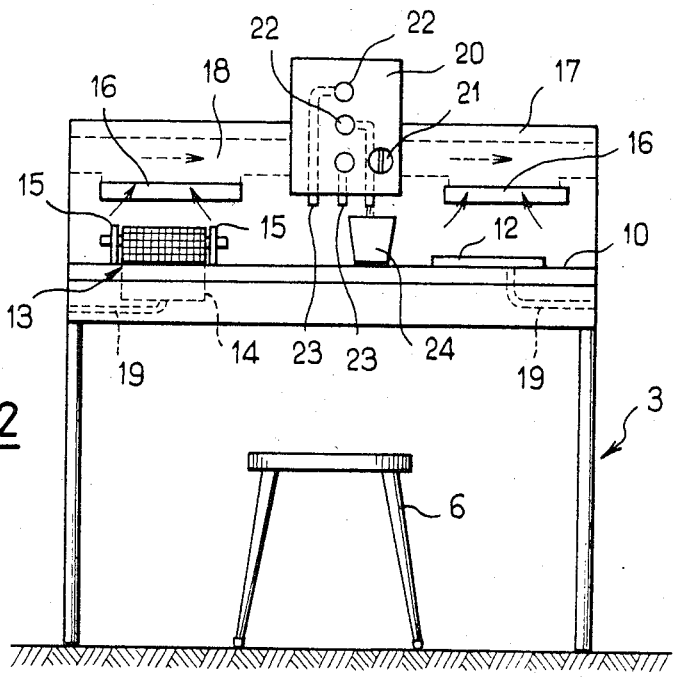
FIG. 2 is a schematic front view of a module of the furniture unit of the installation as shown in FIG. 1.
Figure 3:
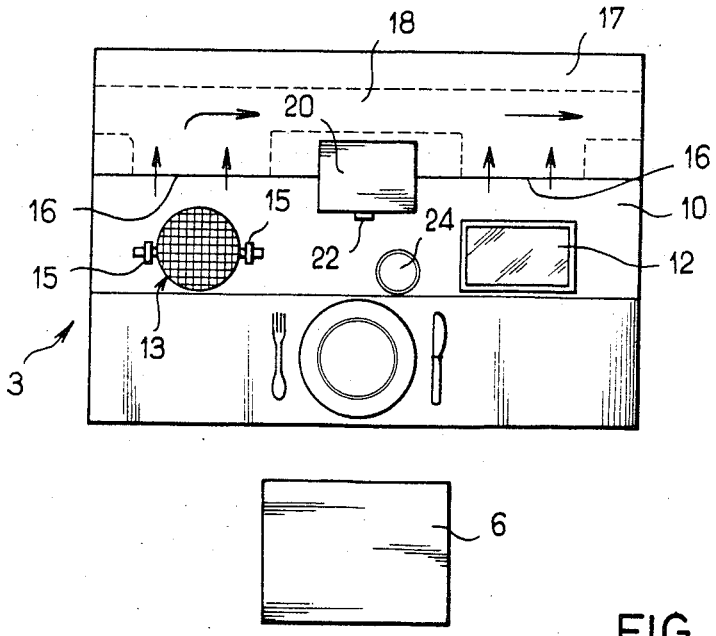
FIG. 3 is a schematic plan view of the module of FIG. 2.
Figure 4:
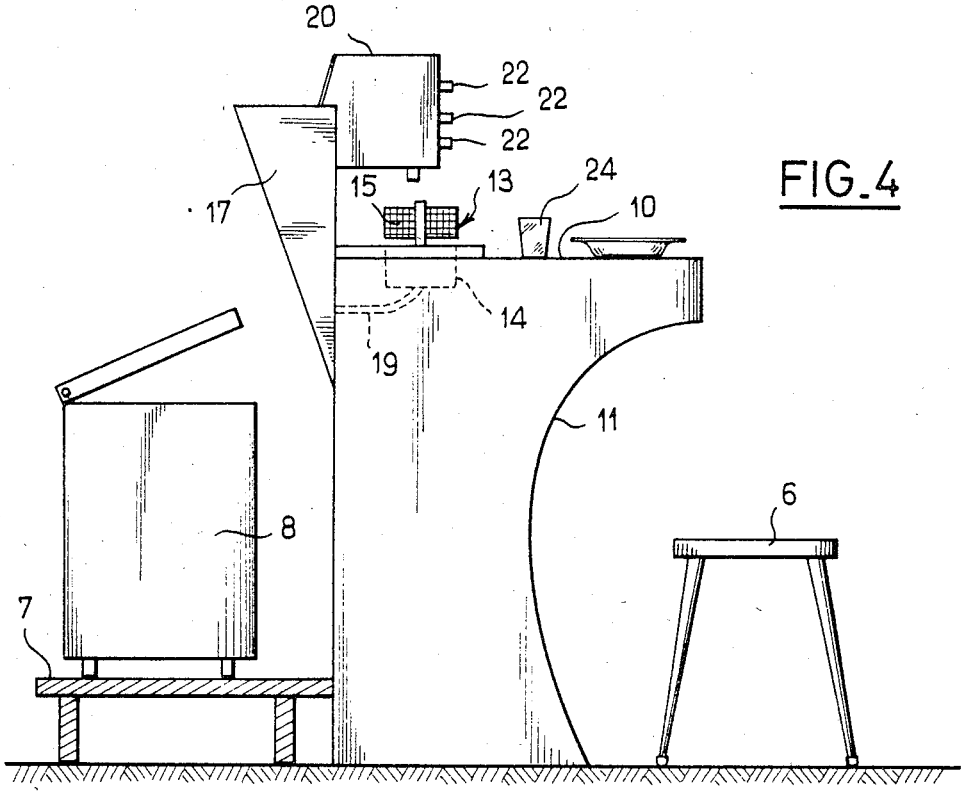
FIG. 4 is a schematic side view of the module of FIGS. 2 and 3.

In FIGS. 2 to 4, there is shown one of the modules such as the module 3 and it will be apparent that the modules 4 are arranged in a corresponding manner. Said module 3 comprises a table 10 having a foot provided with a concave recess 11 which enables customers to be comfortably seated at said table 10. In the surface of the table 10 are incorporated on the one hand an electric hotplate 12 which also performs the function of a meat grill and on the other hand the oil container 14 of an electric deep-fryer 13, the basket of which is pivotally mounted on lateral upright members 15 and capable of withdrawal into the interior of the oil container 14. Said container is placed above heating resistors which are screened electric resistors housed at the bottom of the cavity in which the oil container 14 is placed.

Suction hoods 16 are mounted above cooking means constituted on the one hand by the hotplate 12 and on the other hand by the electric deep-fryer 13. These hoods 16 are supported in an overhung position above the table 10 by a console 17 having a triangular vertical cross-section and attached to the table 10 on the same side as the roller-track 7. The ducts 18 for evacuation of smoke drawn-up through said suction hoods 16 extend through the top portion of the console 17 from one module to the next up to the end of the furniture unit. At this end location, said smoke ducts are joined to an evacuation chimney by means of a connecting duct. On the other hand, the electric leads 19 for the supply of current to the heating resistors of the hotplates 12 and of the electric fryers 13 pass within the thickness of the tables 10 and within the bottom portion of the consoles 17 from one module to the next up to the power supply line. Each console 17 also supports, in an overhung position above the table 10, an automatic beverage dispenser 20 provided with a slot 21 for the introduction of coins in order to initiate operation of the dispenser, and with push-buttons 22. A downward thrust exerted on said push-buttons has the effect of actuating electrovalves for dispensing different beverages. By selecting the push-button 22 to be depressed, the customer can accordingly choose the hot or cold beverage which he or she desires to drink and which is delivered by a nozzle 23 into a glass or tumbler 24.

Figure 5:
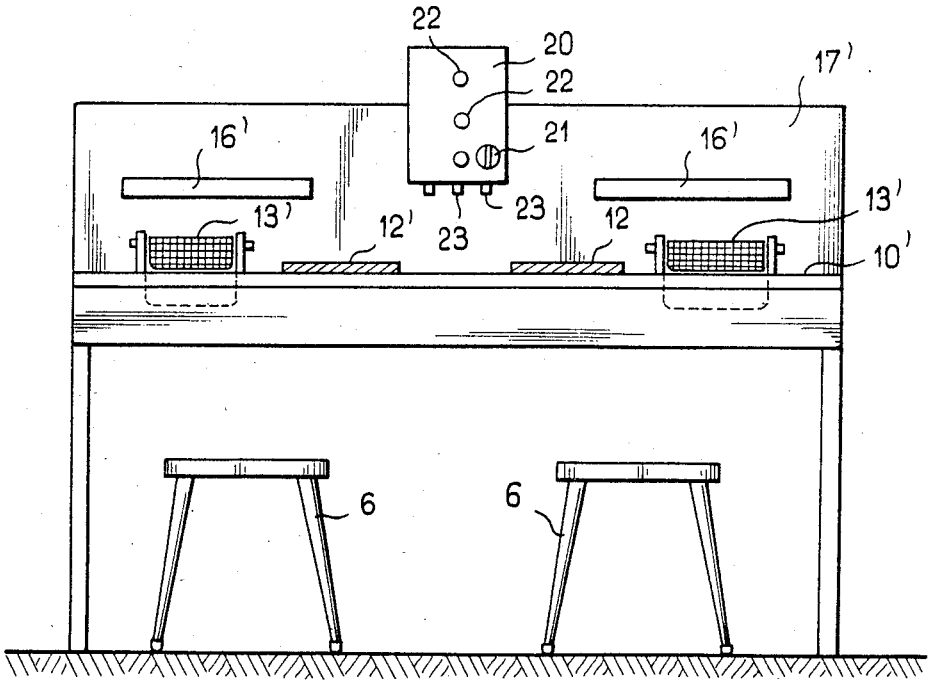
FIG. 5 is a view which is similar to FIG. 2 and shows a module which is intended to be used by two customers at the same time.

Whereas FIGS. 2 to 4 show a module 3 which is intended to meet the requirements of one customer at a time, FIG. 5 shows a dual module designed to accommodate two customers at the same time.

This dual module comprises, on one and the same table 10', two electric deep-fryers 13' and two electric hotplates 12' which are identical respectively to the fryers 13 and hotplates 12 of the preceding example and are placed symmetrically with respect to the central portion of the table 10' above which is located the single automatic beverage dispenser 20 of said module. As in the module 3 described in the foregoing, said dispenser 20 is carried by the console 17' which also supports the two suction hoods 16'. Each hood draws-up the smoke produced indifferently by the hotplate 12' and/or by the fryer 13' which are placed on the same side of the table 10'.

It will readily be apparent that two seats 6 such as stools, for example, are associated with this dual module.

A single furniture unit of a "fast-food" or quick-meal restaurant installation can comprise a predetermined number of single-seat modules as well as a predetermined number of two-seat or dual modules.

The table 10 of each module can also be provided with one or a number of drawers in which the customer will be able to find accessories such as paper napkins or spare knives, forks and spoons as well as condiments or potted spices such as, for example, mustard, a salt cellar and a pepper-pot, as well as bottles for seasoning, salad dressing or sauces such as tomato sauce. These drawers are also designed as automatic dispenser drawers which deliver the products mentioned above in unitary doses as a result of insertion of coins in the slot of a suitable control mechanism.

Similarly, the cooking means of the modules can comprise a microwave oven and each module will advantageously be provided with a timer of the type comprising a bell and/or a warning lamp for indicating the end of a cooking period chosen by the user and corresponding for example to the position of a knob for controlling the cooking means on one of a number of index marks related to the different degrees of cooking of food products.

Compartments which may be locked if necessary can be provided beneath the tables 10 or 10' of the different modules in order to enable customers to store personal effects during their meal.

In addition, the fryer 13 could be equipped with means for tilting the basket automatically at the end of the frying operation in order to discharge its contents directly into the diner's plate.

Furthermore, the modules 3 could be placed in two adjacent rows, which would permit a saving of space. It would also be possible in this case to provide only two deep fryers, two hotplates and a single beverage dispenser for four diners.

What is claimed is:

1. A quick-meal restaurant installation comprising in a room open to customers, a furniture unit adapted to define a service space on one side of said unit, seats for the use of customers on the other side of said unit, the furniture unit being made up of modules assembled together, each module comprising a portion forming a table, said table having a surface having cooking means comprising at least one electric hotplate adapted to operate as a meat grill, and at least one electric deep-fryer; there being at least one said seat opposite each module, a beverage dispenser for dispensing a plurality of beverages, supported by a console and suspended above the table, said beverage dispenser comprising push-buttons adapted to be depressed by the customer for selecting different hot and cold drinks, and a suction hood mounted above the hotplate and the deep-fryer for evacuating fumes generated by the cooking.

2. An installation according to claim 1, wherein the beverage dispenser (20) comprises means (21) for inserting coins in order to initiate operation of said dispenser.

3. An installation according to claim 1, wherein the furniture unit (1) comprises at least one module intended for two customers at the same time, this module being equipped with cooking means (12', 13') for each of the two customers and with only one beverage dispenser (20).

4. An installation according to claim 1, wherein a roller-track (7) extends alongside the furniture unit (1) on the same side as the service space (5) and at least one container (8, 9) such as a freezer compartment, a garbage container or a container for plates and dishes or for knives, forks and spoons is adapted to travel along said roller-track.

5. An installation according to claim 1, wherein the furniture unit (1) has the shape of a U when viewed on a horizontal plane and the service space (5) is defined within the interior of the U.

* * * * *